United States Patent [19]

Salm

[11] Patent Number: 4,508,480

[45] Date of Patent: Apr. 2, 1985

[54] MANUFACTURE OF TINPLATE AND TINPLATE CONTAINERS

[75] Inventor: Dietmar F. E. Salm, Bulli, Australia

[73] Assignee: The Broken Hill Proprietary Company Limited, Melbourne, Australia

[21] Appl. No.: 355,186

[22] Filed: Mar. 5, 1982

Related U.S. Application Data

[60] Division of Ser. No. 228,375, Jan. 26, 1981, abandoned, which is a continuation of Ser. No. 13,917, Feb. 22, 1979, abandoned.

[30] Foreign Application Priority Data

Mar. 29, 1978 [AU] Australia ..... PD3490

[51] Int. Cl.[3] ..... B21D 51/26

[52] U.S. Cl. ..... 413/1; 204/35.1; 428/648

[58] Field of Search ..... 413/1, 26; 204/28, 35; 428/648

[56] References Cited

U.S. PATENT DOCUMENTS

| | | | |
|---|---|---|---|
| 2,144,634 | 1/1939 | Murch | 413/26 |
| 2,585,902 | 2/1952 | Gray | 204/54 R |
| 2,648,625 | 8/1953 | Buser | 204/28 |
| 2,758,075 | 8/1956 | Swalheim | 204/54 R |
| 2,964,006 | 12/1960 | Johnson | 413/1 |
| 3,655,349 | 4/1972 | Shah et al. | 428/648 |
| 3,799,750 | 3/1974 | Bird et al. | 428/648 |
| 3,997,301 | 12/1976 | Yoshihara | 428/648 |
| 4,145,263 | 3/1979 | Tsutsui | 204/35 |

*Primary Examiner*—Leon Gilden

*Attorney, Agent, or Firm*—Murray, Whisenhunt and Ferguson

[57] ABSTRACT

Tinplate container with externally welded seam is formed of electrolytic unreflowed tinplate with external tin coating of low coating mass (less than 2 g/m$^2$); the solderability of such tinplate being comparable with conventional reflowed tinplate of much higher coating mass. The unreflowed tinplate of low coating mass may be produced by Halogen electrotinning process in which ratio of fluoride ions to stannous tin ions in the rinsing section is maintained at unprecedented high level (not less than 10:1), the pH of the rinsing agent is maintained at less than 4 and the current density of the electrodeposition current is in the range 600 to 1,600 amperes per square meter of strip steel.

12 Claims, 14 Drawing Figures

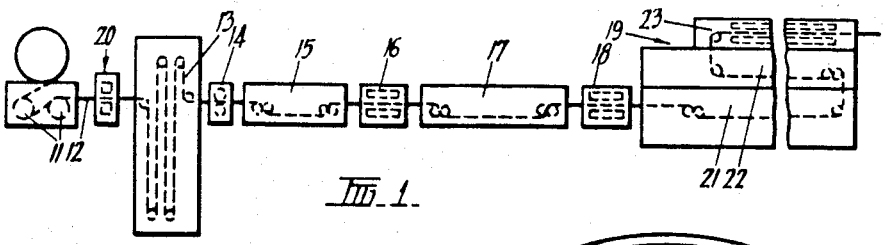
Fig. 1.
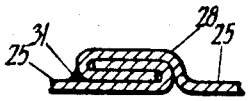
Fig. 3.
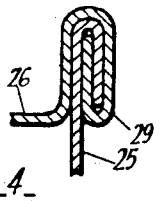
Fig. 4.
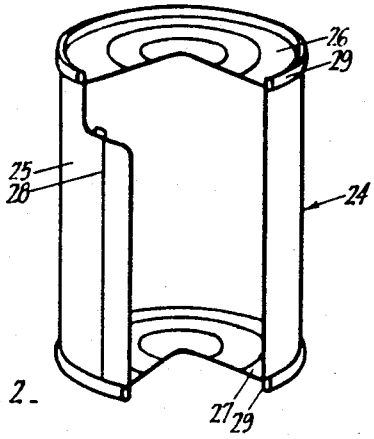
Fig. 2.
Fig. 5.
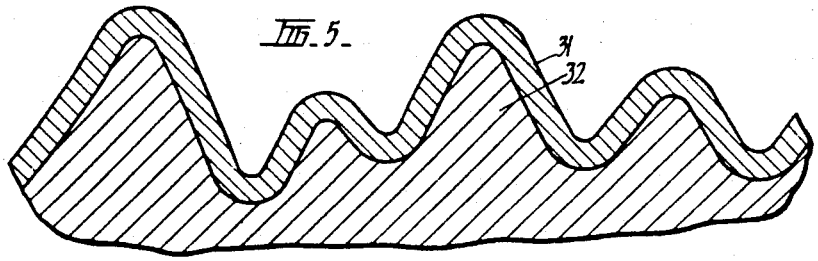
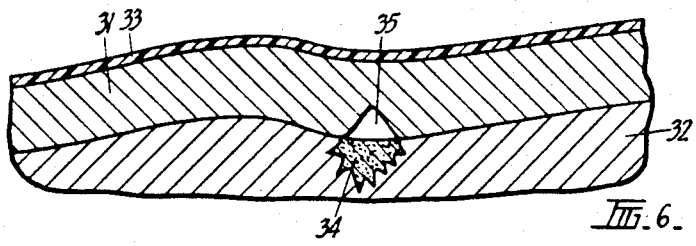
Fig. 6.
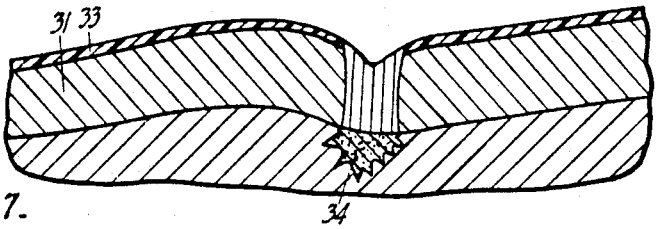
Fig. 7.

MANUFACTURE OF TINPLATE AND TINPLATE CONTAINERS

This is a divisional application of Ser. No. 228,375 filed Jan. 26, 1981, now abandoned, which is a continuation of Ser. No. 13,917, filed Feb. 22, 1979, now abandoned.

BACKGROUND OF THE INVENTION

This invention relates to the production of tinplate and tinplate containers, particularly containers or cans of the type having tubular walls with soldered longitudinal seams.

Tinplate for can-making is generally produced by electrodeposition of tin onto continuous steel strip. In a typical electrolytic line coil fed steel strip is subjected successively to electrolytic cleaning, light pickling, electrolytic tinning, thermal reflowing of the deposited tin and a final chemical or electrochemical "passivation" treatment. The thermal reflowing operation, also known as "flow-brightening", involves melting the plated tin coating by conduction, radiation or high frequency induction heating to a temperature slightly above the melting point of tin whereby the tin flows to produce a smooth bright surface and a portion of the tin combines with the steel of the base strip to form an alloy layer.

There are three general types of electrolytic tinning processes which differ from one another mainly in the type of electrolyte used. In phenolsulphonicacid lines, also known as vertical acid or "Ferrostan type" lines, the electrolyte is contained in vertical compartments and the steel strip is passed downwardly into these compartments between banks of tin anodes. Alkali or "stannate" lines, while essentially of the same basic design, make use of an alkaline sodiumstannate electrolyte.

The third general type of electrolytic tinning line is known as the "Halogen-type" line. In these lines a Halogen-type electrolyte is held in a series of small cells each with its own circulation system, contact roll and anode bank. The steel strip is passed horizontally across the upper surface of the electrolyte in a series of the cells so as to be plated on the bottom side only. It is then passed upwardly and backwardly so that the original top of the strip becomes the bottom and it is passed across a further series of plating cells so that its other side becomes coated with tin. Halogen-type lines can be operated at high strip speeds and have the advantage that differential weight coatings can be applied to the strip i.e. coatings of differing thickness can be applied to the two sides of the strip.

Modern high speed can-making lines have resulted in increasing quality demands on tinplate manufactuers. This is particularly so in the case of the production of cans with soldered seams where the problem of poor solderability during high speed can body making is most frustrating.

At the present time tinplate cans with longitudinal seams are universally made of reflowed ("flow-brightened") tinplate having a coating mass of at least 2.5 g/m$^2$. This has been considered necessary to achieve adequate corrosion resistance and solderability. The present invention has arisen from research which indicates that low tin coating mass unreflowed tinplate, when produced under suitably controlled conditions, can have comparable performance to bright tinplate of considerably higher coating mass, enabling the use of cheaper material for can-making while at the same time alleviating the problem of solderability in high speed production lines.

SUMMARY OF THE INVENTION

According to the invention there is provided a method of producing a container including a tubular tinplate wall having an externally soldered longitudinal seam wherein said wall is formed of electrolytic unreflowed tinplate having on its face which defines the outer side of the tubular wall a tin coating of coating mass less than 2 g/m$^2$, and preferably in the range 0.5 to 1.5 g/m$^2$.

The tinplate may have substantially equal coatings of tin on both sides or alternatively it may have a thicker coating on one side than on the other.

The invention further provides a container of the type including a tubular tinplate wall having an externally soldered longitudinal seam wherein the tinplate of said wall is unreflowed electrolytic tinplate having an external tin coating of coating mass less than 2 g/m$^2$, and preferably in the range 0.5 to 1.5 g/m$^2$.

During the production of suitable low coating mass tinplate by means of the Halogen process it has been found that it is most important to minimize precipitation of hydrated tin compounds onto the tin coatings in the rinsing section. This can be achieved by maintaining a high concentration of fluoride ions in the rinsing agent and also maintaining the proportion of fluoride ions to stannous tin ions in the rinsing section at an unusually high level.

Accordingly, the invention also extends to a method of producing electrolytic tinplate by the Halogen process comprising electrodepositing coatings of tin on opposite faces of strip steel from an electrolyte containing stannous tin and fluoride ions and rinsing the coated strip in a rinsing agent containing fluoride ions and, due to carry-over of electrolyte on the coated strip, stannous tin ions, wherein the tin is electrodeposited on at least one of the said faces to a coating mass of less than 2.5 g/m$^2$ and the ratio of fluoride ions to stannous tin ions ($F^-$: $Sn^{++}$) in the rinsing agent is not less than 10:1.

Preferably, the concentration of fluoride ions in the rinsing agent is not less than 8 g/l. More particularly, it is preferred that this concentration be in the range of 10 to 20 g/l.

The ratio of fluoride ions to stannous tin ions ($F^-$: $Sn^{++}$) in the electrolyte may be in the range 8:1 to 15:1.

The electrolyte may be comprised of stannous tin ions, chloride ions, fluoride ions, ferro-cyanide and a brightening agent.

The rinsing agent may comprise an aqueous solution of sodium bifluoride and/or sodium fluoride.

Preferably, the coating on said one face is electrodeposited to a coating mass in the range 0.5 to 1.5 g/m$^2$.

It has also been found that precipitation of hydrated tin compounds onto the tin coatings in the rinsing section can most effectively be reduced if the fluoride ions in the rinsing agent are in a suitable form to complex with tin and this occurs only in an acid environment. More particularly, it has been found that the pH value of the rinsing agent should preferably be maintained below 4, for example by the addition of hydrochloric acid. Commercial concentrated hydrochloric acid has been found to be suitable.

The invention also extends to electrolytic unreflowed tinplate produced by the above process.

BRIEF DESCRIPTION OF THE DRAWINGS

The invention will be more fully explained with reference to the accompanying drawings in which:

FIG. 1 is a schematic illustration of a horizontal acid or Halogen-type electrolytic tinning line;

FIG. 2 is a broken-away perspective view of a typical can with double seamed ends and lock and soldered side seam;

FIG. 3 is a cross-section through the side seam of the can shown in FIG. 2;

FIG. 4 is a cross-section through one of the end seams of the can;

FIG. 5 is a micro-profile of an electrolytically deposited tin coating on a steel strip;

FIGS. 6 and 7 illustrate the effect of thermal reflowing or flow-brightening on the coating;

DESCRIPTION OF PREFERRED EMBODIMENTS

Figure 8:
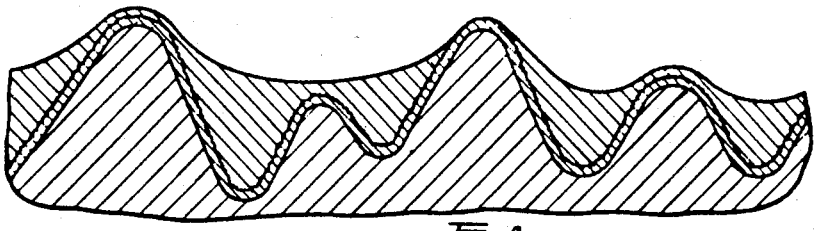
FIG. 8 illustrates the structure resulting from flow-brightening.

The Halogen-type electrolytic tinning line schematically illustrated in FIG. 1 comprises a pair of uncoilers 11 for uncoiling strips of steel. This permits the operator to "pay off" from one uncoiler while charging a coil into the other. The steel strip 12 is fed from the respective uncoiler through an accumulator or "looper" 13 whence it passes at high speed through a dynamic tension device (drag bridle) 14 and through an alkaline electrolytic cleaning bath 15, a rinsing unit 16, a pickler 17 and further rinsing unit 18 to the electrolytic plating unit denoted generally as 19. The accumulator or "looper" 13 is provided to accumulate strip material and to allow the accumulated material to be fed out so as to maintain continuous strip feed to the main process line during coil changing, when the leading end of the new coil is welded to the tail of the preceding coil at a shearing and welding station 20.

In the electrolytic plating unit 19, the steel strip passes over a series of electrolytic cells 21 each with its own circulation system, contact roll and tin anode bank. The tanks are designed so as the strip is barely immersed in the electrolyte and is plated on the bottom side only. The strip then passes upwardly and backwardly over a further series of electrolytic cells 22 so that its reverse is coated.

On leaving the electrolytic plating unit, the double-coated strip is passed through a rinsing tank 23 and a "passivation" treatment tank (not shown). It may also be passed through an oil coater and via a further accumulator to a recoiling unit (also not shown).

Typically the electrolyte in electrolytic cells 21 may have the following compositions:

stannous ions ($Sn^{++}$): 12 to 25 grams per liter;
chloride ions ($Cl^-$): 38 grams per liter;
fluoride ions ($F^-$): 34 grams per liter;
ferro-cyanide: 0.75 grams per liter;
brightening agent: 3.5 grams per liter.

Under operating conditions the ratio of fluoride ions to stannous tin ions ($F^-$:$Sn^{++}$) in the electrolyte will normally fall within the range 8:1 to 15:1.

The rinsing agent in tank 23 may comprise demineralized water and dissolved sodium bifluoride ($NaHF_2$) or sodium fluoride (NaF). Under operating conditions the rinsing agent will also contain a portion of both stannous and stannic tin, chloride and fluoride ions due to the electrolyte carried over by the strip from the plating unit. Appropriate apparatus is provided to recover electrolyte from the rinsing tank and to return it to the electrolytic cells of the plating unit.

The illustrated Halogen-type line is entirely conventional and details of the electrolytic cells and the ancillary equipment will be well known to those skilled in the electrolytic tinning art.

FIG. 2 illustrates a typical tinplate can 24 comprising a tubular side wall 25 and ends 26, 27. The tubular side wall has a longitudinal lock and soldered seam 28 and the two ends are connected to the side wall by double lock seams 29. The formation of the side seam 28 is shown in FIG. 3 and that of the double lock seams 29 is detailed in FIG. 4.

The can construction shown in FIGS. 2 to 3 is entirely conventional and may be produced on modern high speed forming machines. In such machines, side wall tinplate blanks are fed to a can body maker which forms them to tubular shape and produces the lock seam 28. The formed bodies then pass across a high speed soldering machine which applies a bead 31 of solder along the outside of the lock seam 28, (see FIG. 3).

The lock seamed and soldered can bodies are passed to a flanging machine which forms an out-turned flange at each end of the body. The flanged bodies are then fed to a double seamer which applies one of the ends to the can body and forms the double lock seam to connect the end of the body. A sealing compound is generally applied before the double lock seam is formed. Usually the can is supplied to the canner with its top open and the top is applied and double lock seamed to the body at the end of a canning line.

Normally, the interior of the can will be provided with a protective coating of lacquer, in which case the lacquer is applied to one side of the tinplate prior to forming. For some applications such as for beverage containers external decorative lacquer coatings are applied prior to forming.

The machinery for manufacturing cans in the above manner has not been described in detail but it will be appreciated that this can-making procedure is conventional and the necessary machinery is well known. The present invention is concerned primarily with the type of tinplate used with such machinery.

When tin is electrolytically deposited by the Halogen process electroplating theory predicts that for the particular range of roughness of the steel base (0.2–1.0 μm CLA 25–150 peaks/cm) the current distribution on the micro-profile of the steel is such that the tin deposit follows, in a parallel manner, the contours of the steel base. This effect is illustrated in FIG. 5 in which the tin coating is indicated as 31 and the steel base as 32.

Microscopic non-metallic particles that are always associated with the steel surfaces will be bridged by the tin during deposition, provided they are not excessively wide. This bridging effect is illustrated in FIG. 6, which shows the tin coating 31 covered by a passivation film 33 and a non-metallic particle 34 bridged by the tin coating to leave a small gap 35.

During thermal reflowing or "flow-brightening", as carried out in conventional processes to give the tinplate the familiar lustre, the evenness of the tin coating is lost and the tin flows, under surface tension control, into the steel base irregularities and temper grind channels to form small pores, as indicated in FIG. 7.

A portion of the tin also combines with the steel base to form an alloy. This effect is illustrated in FIG. 8 where it can be seen that the overall effect of reflowing is that of creating a very uneven coating mass and providing reduced coverage on the peaks. In some instances the peaks may be covered by alloyed tin only.

Dewetting on non-metallic surfaces depends on the ratio of the tin thickness to the width of the inclusion, and the surface tension of the tin. Low tin coating masses such as EO5 (2.8 g/m$^2$) favour dewetting and as the tin coating mass is reduced further, dewetting becomes more severe. The dewetted areas of the steel base and their associated pores become "plugged" with chromium compounds during the chemical passivation stage of tinplate manufacture and during the soldering process these areas, together with some alloy coated peaks act as pinch-points to hinder the flow of the solder. As a result tinplates with coating masses less than EO5 have not to data found application in can-making.

If the as-deposited tin form is not reflowed, then non-metallic inclusions that have been bridged by tin will remain hidden, thus causing fewer pinch-points and a corresponding improvement in solderability.

Figure 9:
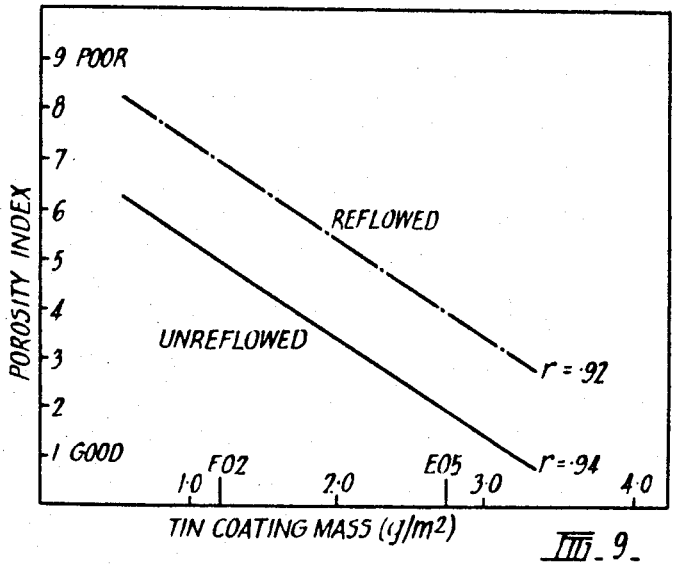
FIGS. 9 to 14 illustrate the results of experiments carried out on samples of reflowed and unreflowed tinplate of varying coating masses.

The increase in the porosity (number of pores) that is experienced as the tin coating mass is reduced is shown in FIG. 9 and it will be seen that unreflowed tinplate is superior to reflowed tinplate in this respect.

Figure 10:
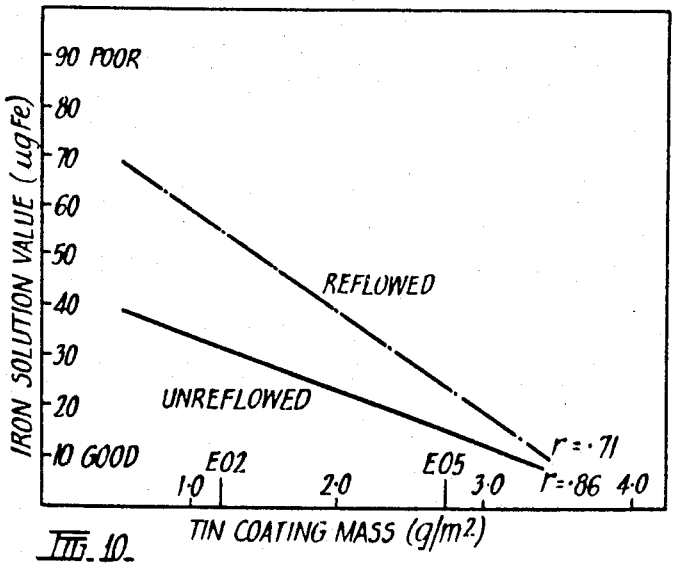

FIG. 10 shows the results of Ion Solution Value Tests (ISV) on samples of unreflowed and reflowed material of various coating masses. The Ion Solution Value Test serves to measure the amount of iron exposure and it will be seen that there is an increase in iron exposure on reflowing. As the tin coating mass is reduced there is an increasing amount of exposed steel but the coverage of the unreflowed tin is clearly superior.

The direct consequences of the results discussed above may be summarized as:

(i) The extent of coverage of the base steel by the tin is the main factor influencing solderability.

(ii) Solderability is therefore independent of tin coating mass. The effect of increasing the coating mass is to overcome the dewetting to some degree and hence indirectly improve the solderability.

(iii) Reflowing as-deposited tin results in dewetting of the steel base by the tin and surface tension controlled tin-flow away from peaks, to the detriment of the solderability performance.

It can therefore be expected that low tin coating mass unreflowed tin plate should have comparable quality performance to bright plate of considerably higher coating mass. Most significantly it may be expected that satisfactory solderability can be achieved with unreflowed tinplate at very low tin coating masses.

To confirm the above results and predictions, unreflowed material was produced with a tin coating mass ranging from 3.36 g/m$^2$ to 0.56 g/m$^2$ (EO6 to EO1) in steps of about 0.56 g/m$^2$ and was subjected to solderability and various corrosion tests. FIGS. 11 to 14 show the results of these tests and a comparison with reflow analogues.

Figure 11:
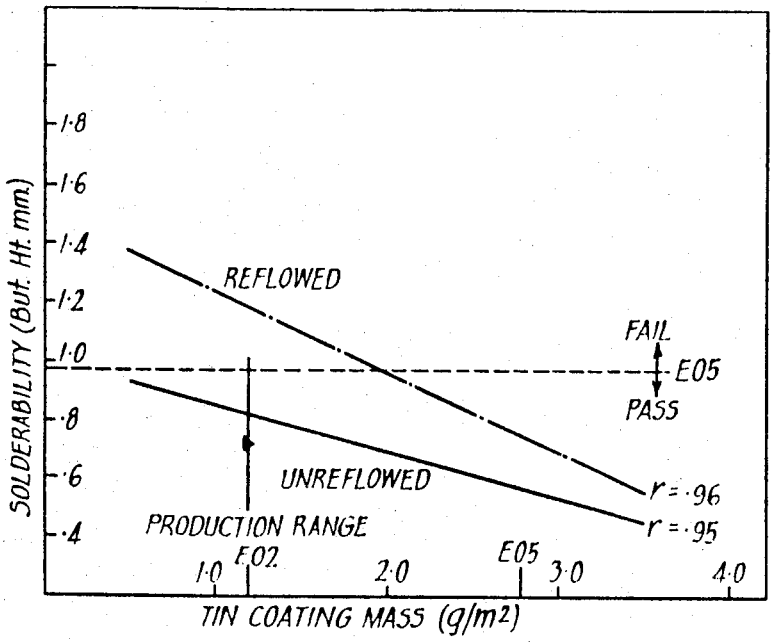
Figure 12:
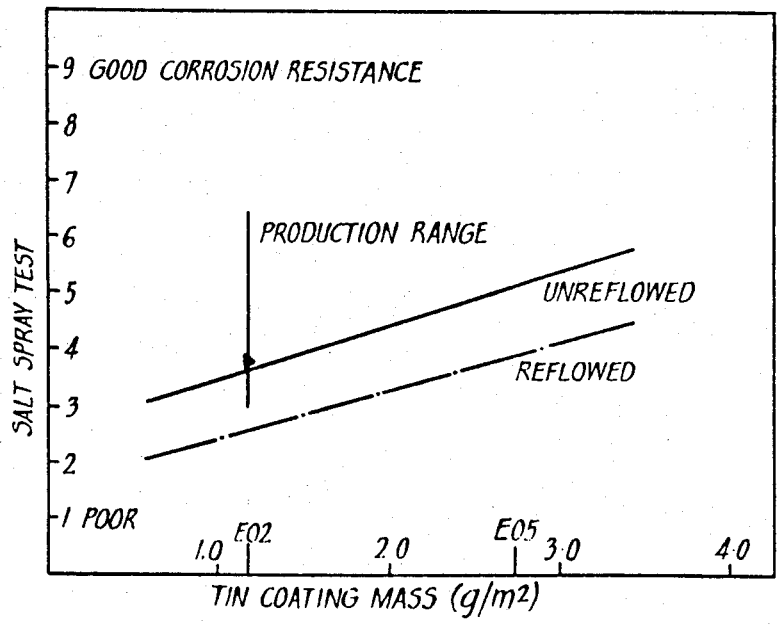
Figure 13:
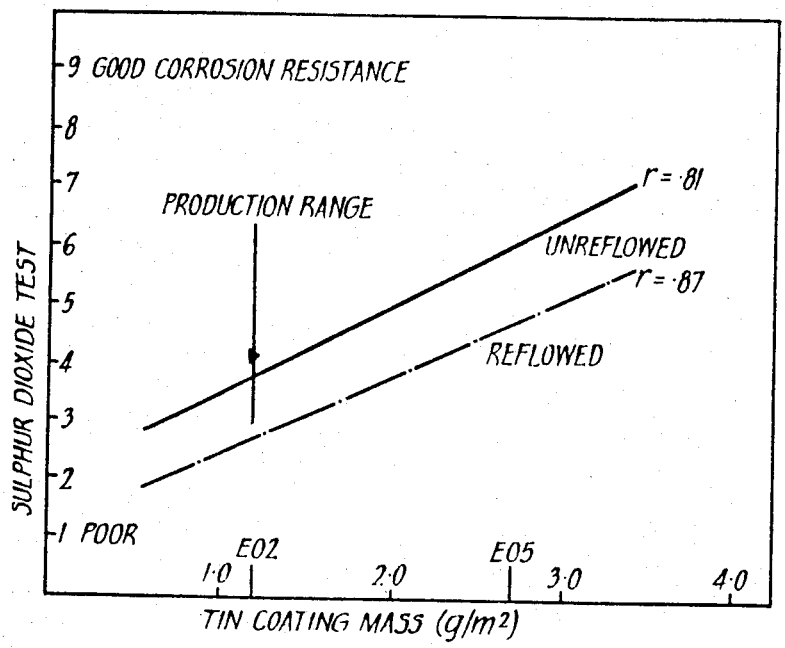
Figure 14:
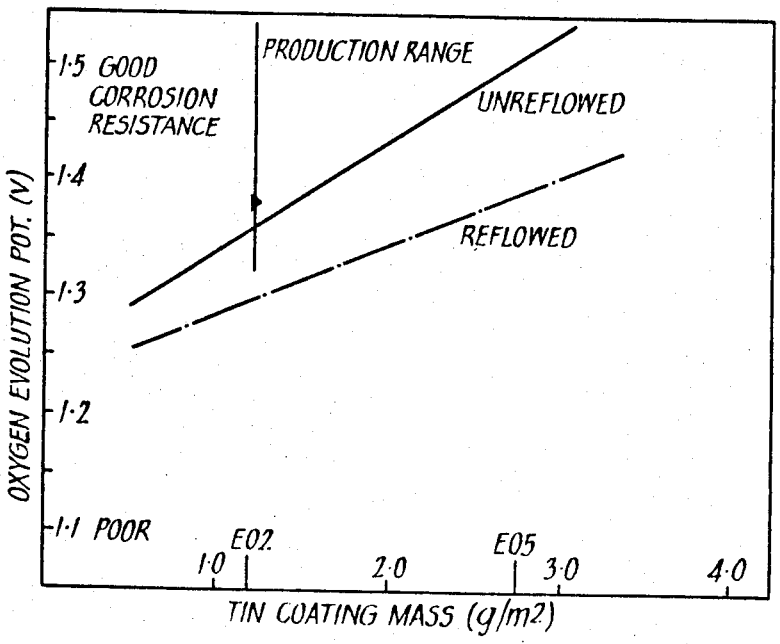

As can be seen from FIG. 11, satisfactory solderability is achieved with unreflowed material having a coating mass as low as 0.5 g/m$^2$ (EO1 is 0.56 g/m$^2$) whereas the reflowed tinplate requires in excess of 2.0 g/m$^2$ more tin to achieve comparable performance.

The phenomenon of dewetting which has been discussed above serves not only to affect the solderability but the degree of exposure of the steel base also governs the external corrosion performance of the tinplate. The relative performance of the unreflowed material and the reflowed analogues in various corrosion tests designed to measure external corrosion resistance is presented in FIGS. 12, 13 and 14. The test results indicate that over the range of tin coating masses considered, the performance of the unreflowed material is clearly superior to that of the reflowed material. The corrosion tests indicate that the corrosion resistance of unreflowed EO2 (1.1 g/m$^2$) material can be reasonably equated with EO4 (2.2 g/m$^2$) to EO5 (2.8 g/m$^2$) reflowed material.

The above tests results were obtained with tinplate produced on a Halogen-type line as illustrated in FIG. 1 and it was found that in order to produce the low coating mass tinplate with improved solderability it is critically important to maintain a high fluoride level in the rinse tank 23. Because unreflowed tinplate relies on the as-deposited coating for its properties, great attention must be paid to the rinsing section to prevent precipitation of hydrated tin compounds onto the coating surface. It was found that solderability failures could occur if the ratio of fluoride ions to stannous tin ions in the rinse tank ($F^-$:$Sn^{++}$) was allowed to fall below 10:1. It was also determined that failures could occur if the fluoride concentration in the rinsing agent was allowed to fall below 8 g/l and that best results were achieved if this concentration was maintained between 10 g/l and 20 g/l.

Extensive trials have further indicated that solderability failures due to deposition of tin compounds onto the tin coatings in the rinsing section can be most effectively avoided if the fluoride ions in the rinsing agent are in a suitable form to complex with tin and this occurs only in an acid environment. Specifically, the trials indicate that, for best results, the pH value of the rinsing agent should be maintained below 4. This may be achieved quite simply by the addition of suitable quantities of commercial concentrated hydrochloric acid.

It is believed that the surprisingly high solderability and corrosion resistance performance of the low coating mass unreflowed material is due to the superior coverage of the steel base, the uniform thickness of the tin deposit on the contours of the steel base and the low level of surface impurities in the tin coating. In order to confirm this performance commercial quantities of unreflowed tinplate having a coating mass of 0.95 g/m$^2$ were produced and this material demonstrated satisfactory performance in laboratory tests and in high speed can-making trials. In one can-making trial, three tonnes of this material were sheared to 800×858 mm and the resulting blanks were divided into two batches which were fed through commercial high speed can-making lines.

From the first batch, beverage cans were manufactured successfully from the trial material. Lacquering, both internally and with a variety of lacquers for external decoration, and soldering performance were rated as very satisfactory. The lacquer baking cycle was most severe in terms of time and temperature and resulted in the alloying of half of the available tin. This means that the free tin level prior to soldering was 0.5 g/m$^2$, only 20% of the free tin levels usually found in EO5, and yet solderability was satisfactory. During this particular trial it was noted that fabrication damage was no more severe than with EO5 material and the application of opaque lacquers rendered the EO2 matte cans almost indistinguishable from EO5 cans.

The second batch of trial material was also used to produce beverage drink cans and again the lacquering and solderability was rated as very good and equal to or better then EO5.

Shelf life tests on the cans produced in the above trials indicate that there is essentially no difference between the shelf life of EO2 matte cans and conventional cans made of EO5 reflowed materials.

Following the two successful can-making trials described above, some thirty-five production trials, each involving at least 3 tonnes of low coating mass, unreflowed tinplate have been the subject of can-making trials; in total some 400 tonnes of the material has been produced and assessed. Approximately 33,000 beer and beverage can bodies have been produced and approximately 32,000 food cans with the latter having both bodies and ends produced from the non-reflowed product. All of these cans have successfully completed at least three months shelf life testing. In some of these latter trials, the cans were soldered with pure tin solders. These are traditionally more difficult to use and have a higher rate of failures with conventional tinplate products than with normal lead-tin solders. The usual minimum coating weight in reflowed product for pure tin solders is EO5 and most can-makers use EO7 or higher for pure tin soldering work. However, the non-reflowed material produced in accordance with the present invention at a coating weight of EO2 has consistently soldered satisfactorily in a commercial can-making line with pure tin solder.

The production trials have also shown that, in order to produce a product of consistent quality, it is important to carefully control the current density in the plating cells. This range of current densities is 600 to 1,600 amperes per square meter and more preferably 800 to 1,200 amperes per square meter. On certain electrotinning line configurations, for a line speed of 550 meters per minute, only 6 to 12 cells would be used within the most preferable current density range. For conventional EO5 reflowed product in a 16 cell line the current density used would typically be 1500 amperes per square meter.

From the above it will be appreciated that the present invention enables production of a tinplate with a tin coating mass reduced by 66% that is satisfactory for high speed can body making and at the same time overcoming the solderability problems encountered with the heavier coating mass tinplate conventionally used in can-making. This material can be produced without mechanical or electrical alterations to existing electrolytic tinning lines and electroplating power requirements are reduced by approximately 60%.

The above trial results are advanced by way of example only and it is to be understood that the invention is not limited to the use of the particular tinplate material used in the trials. Clearly, a range of low coating mass unreflowed tinplates may be produced for use in accordance with the invention. Tinplate with equal coating masses on the two sides would normally be used in the manufacture of lacquered cans. However, in the case of unlacquered cans such as are used in canning some fruits and fruit juices it would be possible to use differential coating masses so as to provide a heavy tin coating on the inside of the can and a low mass coating on the outside to achieve solderability and corrosion resistance in accordance with the principles of the invention.

Although the longitudinal seam of the typical can illustrated in FIGS. 2 to 4 is a lock seam, the low coating mass, unreflowed tinplate produced in accordance with the present invention is equally suited to lap seams, which can be used in cans for non-corrosive or unpressurized contents.

It would also be possible to produce cans in accordance with the invention from low coating mass unreflowed tinplate formed by electrotinning processes other than the Halogen process.

It is accordingly to be understood that many variations will fall within the scope of the appended claims.

I claim:

1. In a method of producing a tinplate container comprising forming an annular container body from tinplate stock, flanging the container body at at least one end thereof and applying a container end to said flanged end, the improvement comprising using, as said tinplate stock, a steel sheet coated on at least one side, wherein the coating consists essentially of an electrolytic unreflowed tin coating having a coating mass of at least about 0.95 and less than 2.5 $g/m^2$.

2. A method as claimed in claim 1, wherein said coating mass is in the range of about 0.95 to 1.5 $g/m^2$.

3. A method as claimed in claim 1, wherein at least the exterior face of said container has said coating thereon, and the container is closed at each end by an end wall in the form of a disc of electrolytic unreflowed tinplate having on its face which defines the outer side of that end wall said electrolytic unreflowed tin coating.

4. Method according to claim 1, wherein said coating is deposited by the halogen process from an electrolyte containing stannous tin and fluoride ions, the rinsing of the coated strip taking place in a rinsing tank containing a rinsing agent containing a concentration of fluoride ions not less than 8 g/l and, due to carryover of electrolyte on the coated strip, stannous tin ions, the ratio of fluoride ions to stannous tin ions ($F^-$:$Sn^{++}$) in the rinsing agent being not less than 10:1.

5. Method according to claim 4, wherein said rinsing agent contains a concentration of fluoride ions of about 10:20 g/l.

6. Method of claim 5, wherein the pH of said rinsing agent is less than 4.

7. In a method of producing a tinplate container comprising forming a container body having a seam along one side thereof from tinplate stock and soldering said seam on a high speed soldering machine, flanging the container body at at least one end, and applying a container end to the flanged end, the improvement comprising using, as said tinplate stock, a steel sheet coated on at least one side, wherein the coating consists essentially of an electrolytic unreflowed tin coating having a coating mass of at least about 0.95 and less than 2.5 $g/m^2$.

8. A method as claimed in claim 7, wherein said coating mass is in the range of about 0.95 to 1.5 $g/m^2$.

9. A method as claimed in claim 7, wherein at least the exterior face of said container has said coating thereon, and the container is closed at each end by an end wall in the form of a disc of electrolytic unreflowed tinplate having on its face which defines the outer side of that end wall said electrolytic unreflowed tin coating.

10. A method of making container bodies of unreflowed electrolytic tinplate comprising:

(a) electrodepositing on at least one face of strip steel a coating consisting essentially of electrolytic unreflowed tin deposited by the halogen process from an electrolyte containing stannous tin and fluoride ions, said coating mass of tin being between about 0.05 and 2.5 $g/m^2$;

(b) rinsing the coated strip in a rinsing agent containing a concentration of fluoride ions not less then 8 g/l and, due to carryover of electrolyte on the coated strip, stannous tin ions, the ratio of fluoride ions to stannous tin ions ($F^-$:$Sn^{++}$) in rinsing agent being not less than 10:1;

(c) subjecting the coated strip to electrochemical passivation treatment;

(d) forming the unreflowed tinplate into bodies each having a side wall by forming an external seam by soldering side wall edges of said tinplate on a high speed soldering machine.

11. A container body made by the method of claim 10.

12. A method of making container body of unreflowed electrolytic tinplate comprising:

(a) electrodepositing on at least one face of strip steel a coating mass of tin by the halogen process from an electrolyte containing stannous tin and fluoride ions, said coating mass of tin being between about 0.95 and 2.5 $g/m^2$;

(b) rinsing the coated strip in a rinsing agent containing a concentration of fluoride ions not less than 8 g/l and, due to carryover of electrolyte on the coated strip, stannous tin ions, the ratio of fluoride ions to stannous tin ions ($F^-$:$Sn^{++}$) in rinsing agent being not less than 10:1;

(c) subjecting the coated strip to electrochemical passivation treatment;

(d) forming the tinplate into bodies each having a side wall by forming an external seam by soldering side wall edges of said tinplate on a high speed soldering machine.

* * * * *